US006553881B2

(12) United States Patent
Marmin

(10) Patent No.: US 6,553,881 B2
(45) Date of Patent: Apr. 29, 2003

(54) CONFIGURATION FOR INTRODUCING MATERIAL WEBS INTO CONVEYING PATHS OF ROTARY PRINTING MACHINES

(75) Inventor: Jean-Claude Marmin, Estrees-Saint-Denis (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/905,854

(22) Filed: Jul. 13, 2001

(65) Prior Publication Data

US 2002/0024175 A1 Feb. 28, 2002

(30) Foreign Application Priority Data

Jul. 13, 2000 (DE) ..... 100 33 957
Apr. 9, 2001 (DE) ..... 101 17 732

(51) Int. Cl.[7] ..... B41F 13/12

(52) U.S. Cl. ..... 83/407; 156/502; 156/510; 156/519; 156/504; 242/553; 242/562.1; 101/227

(58) Field of Search ..... 83/407, 508.2; 156/64, 502, 510, 519, 504; 101/227, 226, 228; 242/553, 562.1

(56) References Cited

U.S. PATENT DOCUMENTS 4,063,505 A 12/1977 Sasamoto et al.
5,052,295 A * 10/1991 Suzuki et al. ..... 101/227
5,078,825 A 1/1992 Hirabayashi
5,275,673 A 1/1994 Suzuki et al.
5,790,168 A * 8/1998 Sano et al. ..... 347/262
6,105,496 A 8/2000 Mayr
6,161,604 A 12/2000 Richards et al.

FOREIGN PATENT DOCUMENTS

DE 42 13 863 A1 11/1992
DE 197 54 106 A1 6/1999
EP 0 355 026 A2 2/1990
EP 0 673 764 A1 9/1995
GB 2 331 984 A 6/1999

* cited by examiner

*Primary Examiner*—Derris H. Banks
*Assistant Examiner*—Dmitry Suhol
(74) *Attorney, Agent, or Firm*—Laurence A. Greenberg; Warner H. Stemer; Gregory L. Mayback

(57) ABSTRACT

The configuration enables the introduction of a material web, which can be divided up into material sub-web strands, into the conveying paths of an angle-bar superstructure of a rotary printing machine. A slitting arrangement, which can be positioned in a variable manner in the angle-bar superstructure, and web drawing-in devices and components for attaching the material web or the material sub-web strands to the web drawing-in devices are provided. Assigned to the web-running plane is an adjustable advancement element which bridges a contact-pressure gap in relation to a mating roller, accommodated in the angle-bar superstructure, and by way of which one of the material sub-web strands or can be attached to an introduction element which can be moved into the web-running plane.

9 Claims, 3 Drawing Sheets

CONFIGURATION FOR INTRODUCING MATERIAL WEBS INTO CONVEYING PATHS OF ROTARY PRINTING MACHINES

BACKGROUND OF THE INVENTION

Field of the Invention

The invention lies in the printing technology field. More specifically, the invention relates to an configuration for introducing material webs or material web strands into rotary printing machines, in particular such material webs or partial webs which, before passing the angle-bar superstructure, are slit and introduced into separate conveying paths.

British patent specification GB 2 331 984 A discloses a web drawing-in device wherein web-guide bars are introduced into the conveying paths of the material web as the latter is threaded. The material web is divided up into web strands by means of a slitting device. The individual web strands are wound around the web-guide bars, with the result that they can always be displaced in one plane. Once the threading operation has been completed, it is possible for the guide bars either to be drawn out of the web path or to be pivoted out of the latter. The disadvantage with this solution is the fact that the introduction bars constitute the components which are to be provided additionally within an angle-bar superstructure and which place additional restrictions on the amount of space available, which is in short supply anyway.

European patent application EP 0 355 026 relates to an automatic web drawing-in device. According to that solution, a slitting arrangement is provided in the angle-bar superstructure of a web-processing rotary printing machine. A web-drawing cable is provided in the vicinity of the slitting arrangement. An adhesive-attachment device is provided on the cable which may be attached to one or more web strands. This takes place by suitable activation of the adhesive-attachment device for applying a supply of adhesive tape to the initial regions of the respectively newly formed sub-web section. Moving the web-drawing cable draws the one or more sub-web strands into the corresponding conveying paths in the angle-bar superstructure of the rotary printing machine.

German patent application DE 197 54 106 A1 relates to a device for, and a method of, drawing in a printing-material web. The solution according to DE 197 54 106 A1 provides for an auxiliary device for drawing in a printing-material web or printing-material sub-web produced from the printing-material web by a slitting arrangement and makes it possible to ensure a mechanical drawing-in operation by means of drawing-in devices even in the region of angle bars. For that purpose, use is made of guide bars which are only introduced along the web course during the drawing-in operation, the printing-material web wrapping around the guide bars, instead of the angle bars, during the drawing-in operation. The guide bars can be either drawn or pivoted out of the web course. It is also possible for angle bars which are mounted on one side to perform the function of the guide bars during the drawing-in operation. This solution makes use of guide means which may be designed as guide bars, as directing rollers or else as angle bars which can be pivoted at right angles to the web-running direction during the drawing-in operation. The guide means may be advanced electrically, hydraulically or pneumatically.

European patent application EP 0 673 764 A1 concerns a device for drawing in printing-material webs via angle bars.

That solution proposes a device in a web-fed rotary printing machine by means of which the printing-material sub-webs produced from a single printing-material web in a slitting direction, using a cutting roller and a cutting ring, can be drawn in further. In this case, at least one of the printing-material sub-webs continues further over angle bars. The printing-material sub-web continuing further over the angle bars is drawn in by means of drawing-in tips which are fastened on lateral sheet chains. The lateral sheet chains, in addition to the movement directions which are possible in the case of a chain, can also be moved in the direction of the longitudinal axis of the rollers and run over guides arranged in a fixed manner outside the displacement and pivoting range of the angle bars. At their rear ends, the drawing-in tips each have two coverings which are located in a flexible manner one above the other and are provided with magnetic sheets which, by virtue of the magnetic attraction, firmly clamp the respective top end of the printing-material sub-web.

SUMMARY OF THE INVENTION

It is accordingly an object of the invention to provide a device for threading material webs into the transport paths of rotary printing machines, which overcomes the above-mentioned disadvantages of the heretofore-known devices and methods of this general type and which allows webs or material sub-web strands which are produced following a slitting operation to be threaded into different conveying paths within an angle-bar superstructure of a web-processing rotary printing machine.

With the foregoing and other objects in view there is provided, in accordance with the invention, a configuration for introducing a material web into conveying paths of an angle-bar superstructure of a rotary printing machine, comprising:

- a slitting arrangement variably positionable in an angle-bar superstructure of the rotary printing machine for selectively dividing the material web into a plurality of sub-web strands;
- web drawing-in devices disposed downstream of the slitting arrangement in a web travel direction and components for attaching the material web or the material sub-web strands to the web drawing-in devices;
- a mating roller disposed in the angle-bar superstructure and defining a web-running plane;
- an adjustable advancement element disposed in the angle-bar superstructure for bridging a contact-pressure gap in relation to the mating roller, and configured to attach one of the material sub-web strands to an introduction element movably disposed into the web-running plane.

The advantages which can be achieved by the solution proposed according to the invention can be seen, in particular, in that arranged in the immediate vicinity of the slitting arrangement is a threading arrangement which is immediately available, if required, for a new operation of drawing a material web into the angle-bar superstructure of a rotary printing machine. Clamped on a plate assigned to a pivotable advancement element is an introduction element which, in the standby position, is already attached at its coupling point to a tongue projecting out of a guide channel. If required, the pivotably arranged advancement element may be advanced during the introduction operation by way of a rotary printing machine operating at crawling speed, with the result that the gap distance between the web-conveying plane and the introduction element still in a standby position can be bridged quickly and an adhesive attachment can be carried out reliably in the direction perpendicular to the slit between sub-webs which are to be introduced. Once the advancement movement has been executed, the introduction element advantageously continues to be guided by contact-pressure rollers, with the result that it does not have to manage on its own during the adhesive attachment to the leading end of the material-web section formed.

In accordance with an added feature of the invention, the introduction element is releasably retained by a clamping device above the web-running plane, in the angle-bar superstructure. That is, an introduction element, which can be attached to a material web or a material-web strand, is accommodated on a clamping device, above the web-running plane. The introduction element, which may for example be of triangular configuration, may thus already be prepared with its adhesive surface oriented in the upward direction, with the result that, if required, it can be attached quickly to the slit material sub-web strand.

In accordance with an additional feature of the invention, the introduction element is partially retained on a circumference of the advancement element.

In accordance with another feature of the invention, the contact-pressure gap is bounded by peripheral surfaces of the advancement element and the mating roller.

In accordance with a further feature of the invention, the introduction element is attached to one of the web drawing-in devices in an inactive state and movable into the web-running plane.

In accordance with again an added feature of the invention, a carrier plate with contact-pressure wheels is connected to the introduction element, and the introduction element carries an adhesive strip and, during an attachment to a material sub-web strand, is guided by the contact-pressure wheels on the carrier plate and the advancement element.

In accordance with again an additional feature of the invention, the advancement element extends substantially over half a width of the uncut material web.

In accordance with again another feature of the invention, the introduction elements, for introducing the material web or the material sub-web strands, include a coupling device.

In accordance with again a further feature of the invention, the introduction elements carry adhesive strips along their base. The strips extend in a direction perpendicular to the conveying direction.

As mentioned above, the introduction element is advantageously guided around an advancement element which interacts with a rotating surface. It is possible for the advancement element to be actuated electrically or by pressure medium, be this by pneumatic or hydraulic means, in order to bridge a contact-pressure gap, and for it to be advanced onto a rotating roller of the angle-bar superstructure. This variant makes it possible for directing rollers which are already present in the angle-bar superstructure in any case, and are intended for guiding the material webs or the material sub-web strands, to be used in order to assist the adhesive-attachment operation.

The contact-pressure gap, wherein the adhesive attachment between the slit sub-web and the introduction element takes place, being limited to only a few mm, is formed by those surfaces of two rollers in the angle-bar superstructure which interact with one another in the case of advancement. Of these rotating surfaces which interact with one another, one may be of stationary design and the other may be of advanceable design, there being no limitations as far as the selection of the surface diameters used is concerned, although rollers of approximately identical diameter are preferably used. In order to allow quick introduction of the slit sub-web strand into the corresponding conveying path within the angle-bar superstructure, the introduction element, while still in the standby position in the angle-bar superstructure, is already attached at its coupling point to a tongue projecting out of the guide channel, with the result that following activation of the advancement element, i.e. the advancement onto the slit material sub-web which is to be conveyed, the latter can be gripped directly and threaded into its conveying path provided in the angle-bar superstructure. In a particularly straightforward configuration of the idea on which the invention is based, the preferably triangular introduction element is provided with an adhesive strip on its side which is directed toward the slit material sub-web. The contact-pressure forces occurring in the contact-pressure gap between the adhesive strip and the slit material sub-web which is to be threaded ensure that the introduction element can be attached reliably to the material sub-web which is to be threaded.

In accordance with a concomitant feature of the invention, it is possible for the advancement element, which is preferably configured in the manner of a roller, to extend over half the width of the uncut material web. This ensures that, in the case of a plurality of slitters being configured one beside the other, it is also possible for material sub-web strands of half width, ¼ width or ⅓ width, which may be produced from an uncut material web following a slitting operation, to be introduced reliably into their respective conveying paths in the angle-bar superstructure of a web-processing rotary printing machine. According to the configuration proposed according to the invention, a slitting arrangement is assigned an additional advancement element in each case. In addition to this, it is also quite possible to provide a plurality of advancement elements, with which in each case individual conveying paths for slit material sub-web strands in the angle-bar superstructure could be provided. The arrangement proposed according to the invention for introducing and/or attaching material webs can be used in web-processing rotary printing machines, for example for jobbing and newspaper-production purposes.

Other features which are considered as characteristic for the invention are set forth in the appended claims.

Although the invention is illustrated and described herein as embodied in an configuration for introducing material webs into conveying paths of rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
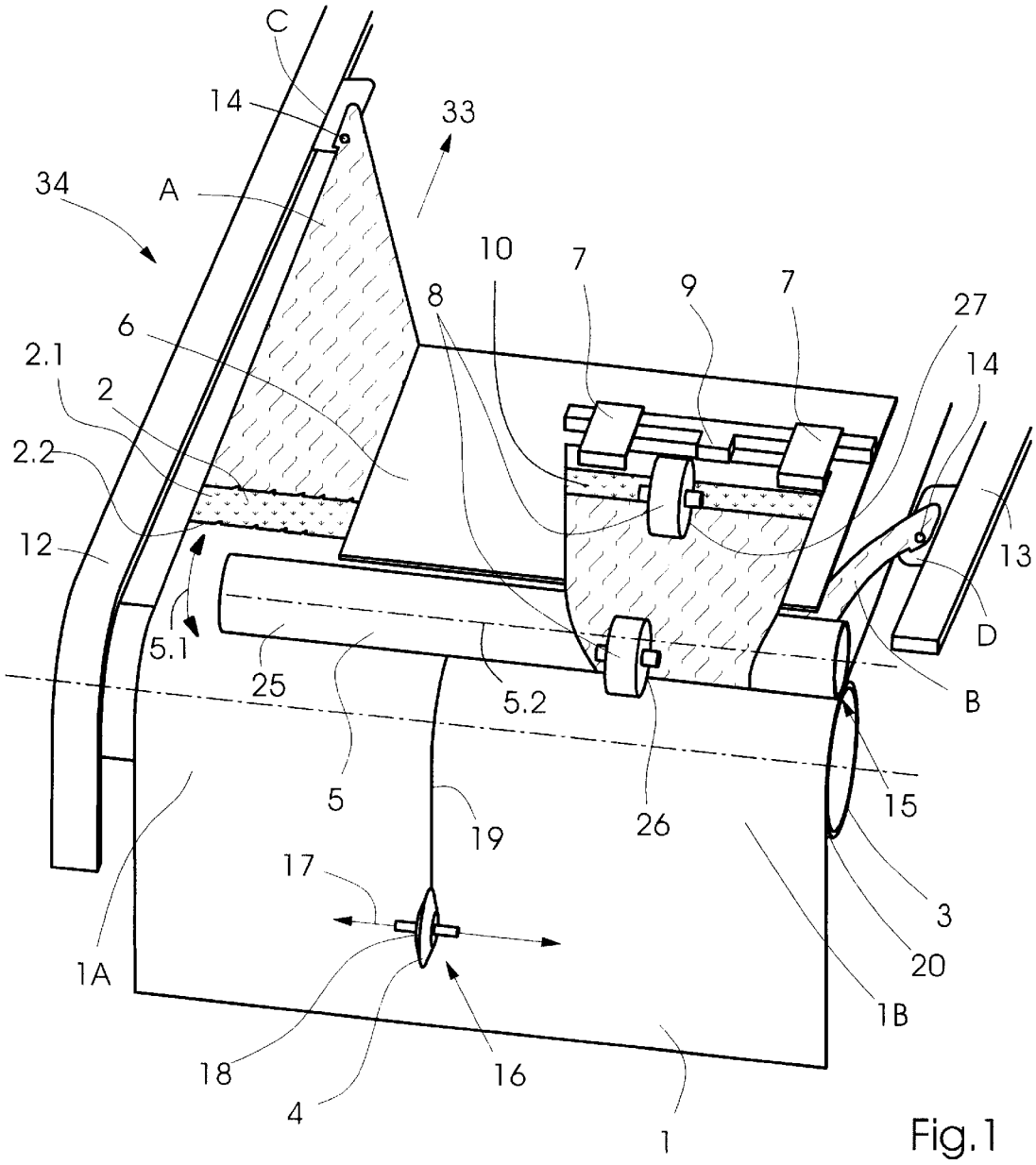
FIG. 1 is a partial perspective view of a threading or introduction element which is wrapped, in part, around an advancement element and can be advanced onto a slit material sub-web.

Referring now to the figures of the drawing in detail and first, particularly, to FIG. 1 thereof, there is shown in more detail a schematic configuration of the advancement element proposed according to the invention in the angle-bar superstructure 34 of a web-processing web-fed rotary printing machine.

An uncut material web 1, which runs onto the rotating mating roller 3 over its entire width, is slit into material sub-webs 1A and 1B by means of a slitter, which is preferably configured as a disk slitter 4. The slitter 4 rotates about an axis of rotation 18 and can be displaced perpendicularly to the web travel direction, in accordance with the schematically depicted double arrow 17. This makes it possible to set different locations for the slit 19 which is to be produced in the uncut material web 1. Instead of the one slitter 4 which is represented here, it is also possible for a plurality of slitters 4 to be distributed over the web width. The numeral 16 designates the currently set cutting position of the slitter 4, at which the uncut material web 1 is provided with a slit 19. After passing the mating roller 3, and following a deflection of approximately 90° by way of the surface 20 of the mating roller 3, the material sub-web strands 1A and 1B run parallel to one another into a web-conveying plane above which an introduction element in the form of a second triangle B is retained on a carrier plate 6. Clamping elements 7 are provided on the surface of the plate-like carrier element 6, as is an aligning element, which is located between the clamping elements, this being an aligning device 9 by way of which the second introduction element B, which is preferably of triangular configuration, is aligned in position on the surface of the carrier plate 6. Furthermore, disk-like contact-pressure elements 8 are assigned to the top side of the carrier plate 6, these elements being advanced onto the surface of the second introduction element B. Part of the surface of the second introduction element B is wrapped around the lateral surface 25 of the advancement element 5. In the front region of the introduction element B, the latter is coupled to a tongue which projects laterally out of a web drawing-in device 13, provided with a slit, on the angle-bar superstructure 34.

The carrier plate 6, on the top side of which the second introduction element B is clamped, is advanced as far as possible onto the lateral surface 25 of the advancement element 5, a small gap being formed in the process. The advancement element 5 is preferably designed as a roller-like body which executes an advancement movement in accordance with the double arrow 5.1 in order to bridge a contact-pressure gap 15 in relation to the mating roller 3, which is accommodated in a stationary manner. The advancement element 5, which is preferably configured as a roller-like body, rotates about an axis 5.2, it being possible for the advancement movement 5.1 to be brought about electrically, pneumatically or hydraulically.

In the exemplary embodiment according to FIG. 1, the second introduction element B is attached to the material sub-web strand 1B by a double-sided adhesive strip 10 which is located on the surface of the second introduction element B and runs parallel to the base side of the latter. The second introduction element B is provided on the drive side D of the angle-bar superstructure 34 and is introduced in its conveying path 23 via a tongue-like element 14 formed on the web drawing-in device 13.

In the variant shown in FIG. 1, the remaining material sub-web strand 1A is likewise attached to an introduction element A, which is in the form of a first triangle. At the tip of the latter, said introduction element is attached at the coupling point 14 to an introduction device which is provided on the operating side C and, likewise configured as a tongue-like element, projects out of a lateral gap of a web drawing-in device 12 and introduces the material sub-web strand 1A into the associated conveying path 22 in the angle-bar superstructure 34.

In the exemplary embodiment according to FIG. 1, the two material sub-web strands 1A and 1B are introduced into the angle-bar superstructure 34 in the conveying direction 33. It is ensured here that each material sub-web strand 1A, 1B is respectively assigned a separate introduction element A, B, with the result that each material sub-web strand may be assigned an individual conveying path 22, 23 (see FIG. 2) through the angle-bar superstructure 34 of a web-processing rotary printing machine. FIG. 1 shows a state wherein the second introduction element B, in a position shown on the carrier plate 6, is inactive, i.e. is not yet attached to the material sub-web strand 1B severed from the remaining material sub-web strand 1A by the slitting arrangement 4.

In the exemplary embodiment according to FIG. 1, disk-like contact-pressure elements 8 have been moved into respective positions 26 and 27 above the carrier plate 6 and surface 25 of the advancement element 5. The positions 26 and 27 of the disk-like contact-pressure elements 8 are advantageously selected such that the adhesive strip located on the top side of the second introduction element B can pass said elements precisely in the region of an interruption in the adhesive layer, with the result that the second introduction element B, accommodated on the surface of the carrier plate 6, can be drawn out of the clamping elements 7 without disruption during advancement of the advancement element 5 onto the top side of the material sub-web strand 1B in the advancement direction 5.1.

Figure 2:
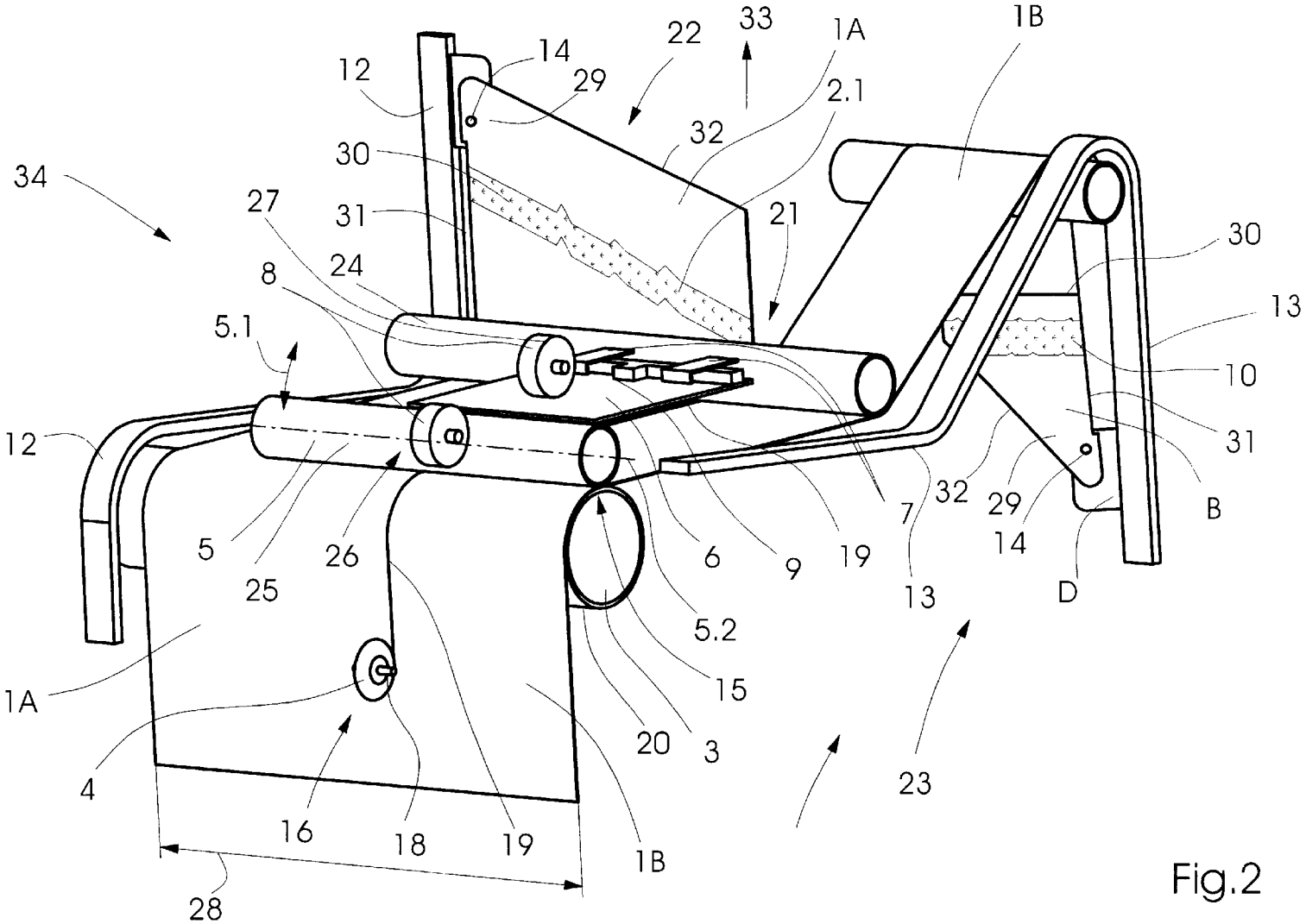
FIG. 2 is a perspective view of two slit material sub-web strands, gripped by their respective threading elements, being conveyed in different sub-web conveying paths after passing a common deflecting roller.

The illustration according to FIG. 2 shows the introduction of slit material sub-web strands 1A, 1B into different conveying paths 22, 23 which extend, in part, jointly in the conveying direction 33.

In the cutting position 16 of the already mentioned slitter 4, which is preferably of disk-like design and rotates about the axis of rotation 18, said slitter produces a slit 19 in the uncut material web 1 running into the angle-bar superstructure 34. Once the slit 19 has been produced, the material sub-web strands 1A and 1B, following a 90° deflection around the lateral surface 20 of the mating roller 3, run into a web-running plane wherein the advancement element 5, which can be pivoted in the double arrow direction 5.1, is accommodated. In the state which is shown in FIG. 2, attachment of the second introduction element B and of the adhesive strip 10 to the material sub-web strand 1B has taken place, said strand already having been conveyed around the deflecting roller 24 and a further roller, producing a deflection of approximately 180°, in the direction of the second web path 23.

In contrast, the material sub-web strand 1A, from which the narrow material sub-web strand 1B has been severed by the slit 19, a cutting gap 21 being formed in the process, has been threaded into its original web path 22 in the conveying direction 33 by the first introduction element A. For this purpose, the first introduction element A is coupled at its coupling point to a web drawing-in device 12, which is provided on the operating side C of the angle-bar superstructure 34. The first introduction element A, which is preferably of triangular configuration, is provided with an adhesive strip 2 on its base 30. The adhesive strip may preferably be configured as a double-sided adhesive tape which comprises a top side 2.1 and an underside 2.2 with adhesive properties.

On the first introduction element A, which is preferably of triangular configuration, a rectilinear side is designated 31, while a side which runs obliquely toward the coupling point 14 is designated 32. The adhesive strips 2 and 10 are respectively applied in the region of the base of the first introduction element A and of the second introduction element B, which may be designed analogously to the first introduction element A.

The illustration according to FIG. 2 shows that following attachment, i.e. the electrical, pneumatic or hydraulic advancement of the advancement element 5 onto the top side of the slit material sub-web strand 1A, the second introduction element B is drawn out of the clamping elements 7 on the top side of the carrier plate 6, with the result that the second introduction element B—deflected by the surface 25 of the advancement element 5—has gripped the leading region of the material sub-web strand 1B. Once the second introduction element B has been released by the clamping elements 7, it is guided by the disk-like contact-pressure elements 8, which are represented in positions 26 and 27 and are illustrated here as being located one behind the other.

Web drawing-in devices 12 and 13 are formed on both sides of the material web 1, said drawing-in devices respectively running on the operating side C and drive side D of the angle-bar superstructure 34 and having tongue-like conveying elements formed in them, said elements ensuring that the material sub-web strands 1A and 1B adhesively attached to the introduction elements A and B, respectively, are introduced into their corresponding conveying paths 22 and 23 respectively, in the angle-bar superstructure 34. It can be seen in the illustration according to FIG. 2 that the contact-pressure gap 15 between the advancement element 5 and the surface 20 of the mating roller 3, which is accommodated in a stationary manner, is of larger dimensions than in the illustration according to FIG. 1. In the illustration according to FIG. 1, in contrast to the illustration according to FIG. 2, the carrier plate 6 is provided with a second introduction element B clamped on it. The smaller the contact-pressure gap 15 between the adhesive-attachment top side of the second introduction element B and the top side of the slit material sub-web strand 1B can be kept, the quicker is it possible to provide an adhesive attachment between the second introduction element B and the material sub-web strand 1B. If attachment between the second introduction element B and the material sub-web strand 1B has taken place, then the contact-pressure gap 15 can assume an extent as is illustrated schematically in FIG. 2. This means that, even in the case of multilayered material webs or material sub-web strands, friction-free conveying through the angle-bar superstructure 34 of a web-processing web-fed rotary printing machine is ensured, be this for jobbing or used for newspaper-production purposes.

It can also be seen from the illustration according to FIG. 2 that once the drawing-up operation has taken place by advancement of the advancement element 5 onto the surface of a slit material sub-web strand 1B, the carrier plate 6 can be fitted with an unused second introduction element B without this having an adverse effect on the material-web transportation, proceeding between the rotating surfaces 20 and 25 of the roller-like bodies 5 and 3, in the conveying direction 33. It is thus possible for a material sub-web strand to be introduced as the current print job is in operation, with the result that setting-up work for a print job with a conveying-path configuration through the angle-bar superstructure 34 which differs from the current job can be carried out as the current print job is in operation. This makes it possible for work to be prepared in a more rational manner, which is important in particular in the case of web-processing newspaper-printing machines since, as experience has shown, only a small amount of time is available during job changeover.

Figure 3:
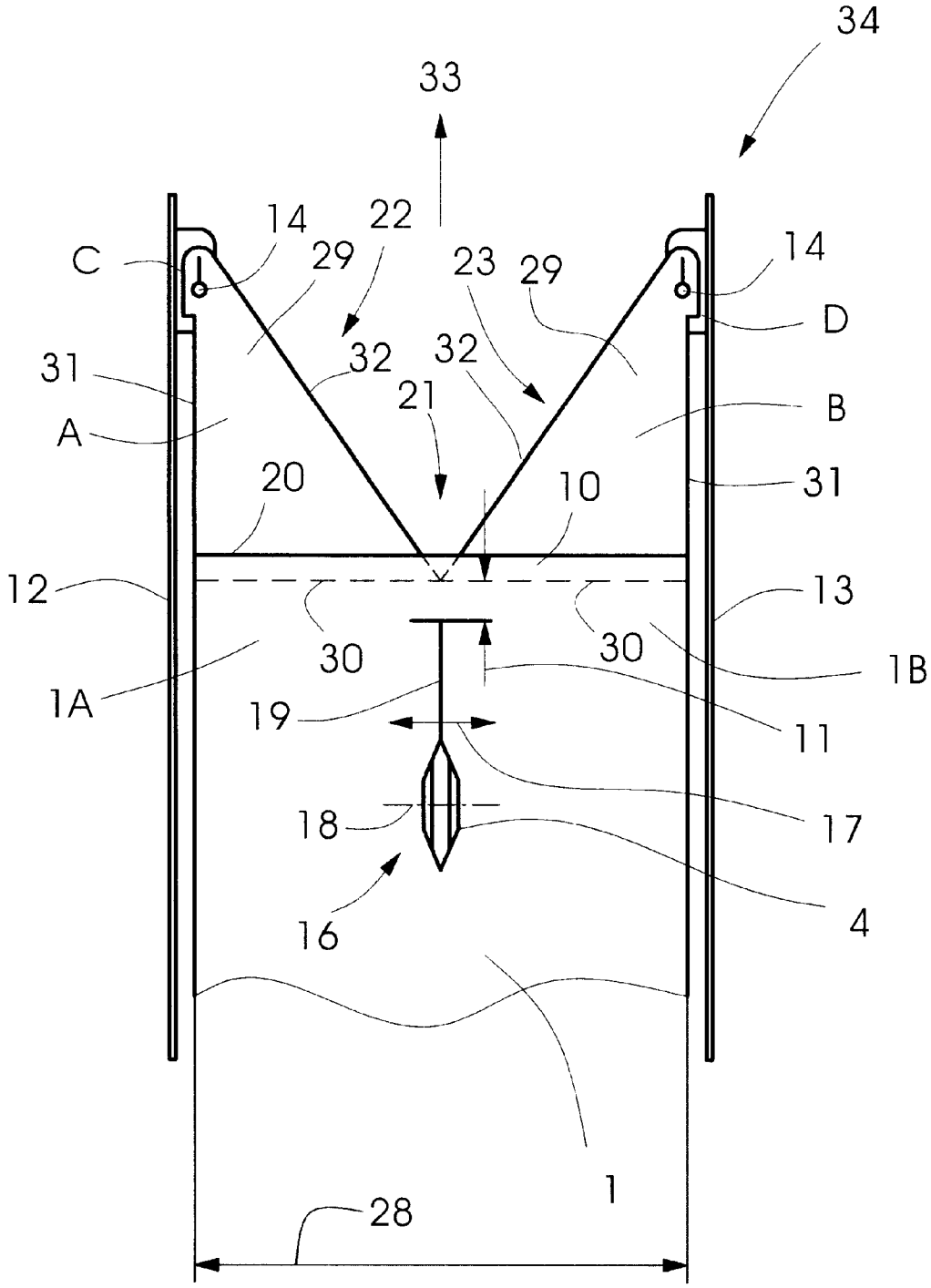
FIG. 3 is a plan view of the severing location, at which an uncut material web is divided up into two material sub-web strands which are conveyed parallel to one another.

The illustration according to FIG. 3 shows the plan view of an angle-bar superstructure 34 in the region of the slitting zone. The slitter 4 has been moved into a cutting position 16 and rotates about an axis 18. The lateral displacement range of the slitter 4 is indicated by the double arrow 17. In addition to the position of the slit 19 over the width 28 of the uncut material web 1, it is, of course, also possible to set other slitting positions by displacing the slitter 4 perpendicularly to the web-conveying direction 33. In addition to the single slitter 4 in the illustration according to FIG. 3 it is also possible for a plurality of circular slitters to be distributed over the web width 28. Located on both sides of the slit 19 are material sub-web strands 1A and 1B which are still attached to one another at their leading ends via an uncut material crosspiece 11 which is common to both. The crosspiece, designated 11, is adjoined by the zone wherein the adhesive strips 2 and 10 are adhesively attached to the respective first and second introduction elements A and B. The slit 19 widens continuously into a gap 21, which increases continuously in the web-conveying direction 33 (see illustration according to FIG. 2). By way of the first introduction element A, the material sub-web strand 1A is guided on the operating side C through the angle-bar superstructure 34, while by way of the second introduction element B, attached by the adhesive strip 10, the material sub-web strand 1B is introduced into its conveying path 23 in the angle-bar superstructure 34 of a rotary printing machine. The two introduction elements A and B are attached at coupling points 14 to their respective web drawing-in devices 12 and 13. Depending on the configuration, i.e. the width of the material sub-web strands 1A and 1B, it is possible for the bevels 32 on the first introduction element A and the second introduction element B to be inclined to different extents.

The double-sided adhesive strips 2 and 10 are preferably fastened on the base 30 of the respective introduction elements A and B and bring about force introduction, extending over the entire width of the material sub-web strands 1A and 1B, respectively, into the material sub-web strands. This reduces the occurrence of web breaks as the material sub-web strands 1A, 1B are introduced into their respective conveying paths 22 and 23 in the angle-bar superstructure 34. Uniform introduction of the web is made possible by the still unsevered material bridge 11 between the material sub-web strands 1A and 1B and the parallel conveying, which can be gathered from FIG. 3, provided by the web drawing-in devices 12 and 13 on the operating side C and drive side D, respectively.

I claim:

1. A configuration for introducing a material web into conveying paths of an angle-bar superstructure of a rotary printing machine, comprising:

a slitting arrangement variably positionable in an angle-bar superstructure of the rotary printing machine for selectively dividing the material web into a plurality of sub-web strands;

web drawing-in devices disposed downstream of said slitting arrangement in a web travel direction and components for attaching the material web or the material sub-web strands to said web drawing-in devices;

a mating roller disposed in the angle-bar superstructure and defining a web-running plane;

an adjustable advancement element disposed in the angle-bar superstructure for bridging a contact-pressure gap in relation to said mating roller, and configured to attach one of the material sub-web strands to an introduction element movably disposed into the web-running plane, said introduction element being attached to one of said web drawing-in devices in an inactive state an being movable into the web-running plane.

2. The configuration according to claim 1, which comprises a clamping device releasably retaining said introduction element above the web-running plane, in the angle-bar superstructure.

3. The configuration according to claim 1, wherein said introduction element is partially retained on a circumference of said advancement element.

4. The configuration according to claim 3, which comprises a carrier plate with contact-pressure wheels connected to said introduction element, and wherein said introduction element carries an adhesive strip and, during an attachment to a material sub-web strand, is guided by said contact-pressure wheels on said carrier plate and said advancement element.

5. The configuration according to claim 1, wherein the contact-pressure gap is bounded by peripheral surfaces of said advancement element and said mating roller.

6. The Configuration according to claim 1, wherein said advancement element extends substantially over half a width of an uncut material web.

7. The configuration according to claim 1, wherein said introduction element is one of a plurality of introduction elements, and said introduction elements, for introducing the material web or the material sub-web strands, include a coupling device.

8. The configuration according to claim 7, wherein said introduction elements carry adhesive strips along a base thereof, said strips extending in a direction perpendicular to the conveying direction.

9. In combination with a web-processing rotary printing machine, the configuration according to claim 1 for introducing a material web or material sub-web strands into conveying paths of an angle-bar superstructure of the rotary printing machine.

* * * * *